United States Patent [19]

Schupphaus et al.

[11] 4,189,188

[45] Feb. 19, 1980

[54] DRUM CUTTER MINING MACHINE

[75] Inventors: Herbert Schüpphaus, Bochum; Klaus Oberste-Beulmann, Sprockhövel, both of Fed. Rep. of Germany

[73] Assignee: Gebr. Eickhoff, Maschinenfabrik und Eisengiesserei m.b.H., Bochum, Fed. Rep. of Germany

[21] Appl. No.: 940,799

[22] Filed: Sep. 7, 1978

[30] Foreign Application Priority Data

Sep. 16, 1977 [DE] Fed. Rep. of Germany ..... 2741660

[51] Int. Cl.[2] ..... E21C 29/22

[52] U.S. Cl. ..... 299/53; 299/46

[58] Field of Search ..... 299/42–46, 299/53, 54

[56] References Cited

U.S. PATENT DOCUMENTS

| | | | |
|---|---|---|---|
| 4,085,974 | 4/1978 | Lanfermann et al. | 299/42 X |
| 4,097,091 | 6/1978 | Knorr | 299/43 X |

*Primary Examiner*—Ernest R. Purser

*Attorney, Agent, or Firm*—Thomas H. Murray; Clifford A. Poff

[57] ABSTRACT

A drum cutter mining machine includes a machine frame with a winch having a drive wheel to engage a rack or chain which extends along the path of travel by the mining machine to propel the machine along a mine face. The mining machine is made up of discrete units which include a machine body and machine housings joined to opposite sides of the machine body. The winch is either coupled through a drive train with a feed drive motor or coupled to the drive motor for cutter drums. The machine housings each support a pivot shaft coupled by an arm to a drum cutter. One of these housings includes a removable end cover and a recess adapted to receive a support housing for a spur gear system used to transmit torque from a feed drive motor to a reduction gear system which is, in turn, coupled to the drive wheel of the winch. In one embodiment, a removable end cover on the machine housing provides access to the feed drive motor. The feed drive motor is arranged so that the rotational axis of its drive output shaft extends transversely to the stow side of the machine frame. In another embodiment, the reduction gear system is arranged at one side of the pivot shaft for the cutter drum while the drive motor therefor is arranged at the other side of the pivot shaft and coupled thereto through the spur gear system. In a further embodiment, the reduction gear system is disposed between the feed motor and the pivot shaft.

12 Claims, 7 Drawing Figures

DRUM CUTTER MINING MACHINE

BACKGROUND OF THE INVENTION

This invention relates to a drum cutter mining machine which is an assembly of separate component parts and equipped with a winch that is either coupled with a separate drive motor therefor, or coupled to a drive motor used for rotating drum cutters; the arrangement of parts being such that the mining machine has at least one drive wheel at an end thereof to engage a toothed rack or chain extending along the course of travel for the mining machine to produce the traversing motion of the machine along a mine face while the cutter drums are driven to work the mine face.

A drum cutter mining machine of this same general type is shown in U.S. Pat. No. 4,067,620 which issued to the Assignee of this invention. In this known drum cutter mining machine, the machine body consists of a number of separate constructional units rigidly joined together. The units include two cutter heads stationed at opposite ends of the machine body with each cutter head being provided with a pivot arm equipped at its end with a cutter drum. The constructional units of the machine also include a winch and a drive motor located between the two cutter heads. The drive motor supplies the necessary torque for rotating the two cutter drums and the winch. A drum cutter mining machine of this type, especially when such a machine is equipped with an additional housing to accommodate an additional drive wheel, has a relatively large overall length and because of its length, it is difficult to introduce the mining machine into the relatively low and narrow region of a longwall mine face belowground. The constructed length of the machine also impairs maneuverability in the confined space of a mine face. Moreover, with this type of drum cutter mining machine, there is a relatively large distance between the respective cutter drums and the drive wheels used to produce the feed motion along the mine face. This is because one of the two cutter heads is always located between the cutter drum and the drive wheel located at the winch or on a special housing. As a result, there is always a relatively large distance between the support runner and the cutter drum because the support runners must always be mounted in the plane of the drive motor shaft in order to insure that the teeth of the drive wheel mesh with the teeth of the rack. The stability of the drum cutter mining machine is impaired due to the overhanging cutter drums.

U.S. Pat. No. 3,594,043 discloses a drum cutter mining machine having winches which are coupled to a drive motor to produce the necessary feed motion of the mining machine through a reduction gear which takes the form of a planetary gear system arranged coaxially with respect to the chain drive wheel of a winch.

SUMMARY OF THE INVENTION

It is an object of the present invention to provide an improved drum cutter mining machine which is assembled from separate component constructional parts and equipped with a separate winch to propel the machine along the mine face wherein the mining machine is particularly characterized by a short overall length brought about by an improved construction and relationship of parts.

More particularly, according to the present invention, there is provided a drum cutter mining machine adapted for movement along a mine face including the combination of a machine frame including a machine body and machine housings joined to the opposite ends of the machine body, a cutter drum including a support arm carried by each of the machine housings, drive motor means supported by the machine frame, means extending along the course of travel by the mining machine for propelling movement thereof along the mine face, a drive wheel carried by at least one of the machine housings to engage the means extending along the course of travel, a drive gear means coupled to transmit torque from the drive motor means to the cutter drum, and a drive train carried by the same machine housing which carries the drive wheel to transmit torque thereto from the drive motor means for propelling movement of the mining machine along the mine face.

To achieve the objectives of the present invention, the drum cutter mining machine is constructed and arranged so that the drum cutter and the machine housings retaining the support arm for the drum cutter respectively include a gear train in addition to the drive system for transmitting torque from the drive motor to the cutter drum. The gear train connects the drive motor carried by the machine housing to the feed wheel for producing the feed motion of the mining machine. By comparison with the drum cutter mining machine shown in the aforesaid U.S. Pat. No. 4,067,620, the drum cutter mining machine constructed in the manner according to the present invention has a much shorter overall length and because it consists of only four constructional units when a single motor is used to actuate the two cutter drums. When the mining machine of the present invention consists of five constructional units, as when each of the two cutter drums is equipped with its own drive motor, a shorter overall length is still achieved by the present invention as compared with the known forms of drum cutter mining machines. Moreover, the present invention provides that there is a smaller number of adjoining faces which reduces the costs to construct the mining machine. The construction of the mining machine of the present invention has the additional feature that the position of the drive wheels which mesh directly with rack teeth are now located more closely adjacent the ends of the machine body such that in addition to the guide runners, which are always located near the drive wheels, the drive wheels are always located in this region of the machine body. Because of this construction, the distance from the cutter drums, which extends outwardly from the body of the machine to the neighboring guide runners, is reduced and, as a result, there is an improvement to the operation of the drum cutter mining machine.

The cutter drums of the drum cutter mining machine of the present invention are, if desired, driven by a single drive motor. In this event, the housing of the machine includes an additional drive motor with the rotational speed thereof steplessly controlled. The additional drive motor is coupled to the drive wheel by a spur gear system and reducing gears, thereby producing the feed motion of the drum cutter mining machine. Moreover, according to the present invention, it is also possible to deliver the necessary torque to the cutting drums and the feed winch drive solely from a drive motor mounted outside the housing of the drum cutter mining machine when there is provided within the machine housing a hydraulic transmission system consisting of a hydraulic pump and a hydromotor whereby the rotational speed of the motor is steplessly adjusted and the rotational motion transmitted by the spur gear system and the reduction gearing to the drive wheel produces the desired feed motion of the mining machine.

According to a further aspect of the present invention, a drum cutter mining machine includes, in addition to a drive motor for rotating the cutter drums, a drive motor to produce the feed motion of the mining machine along the mine face. The drive motor for producing this feed motion is mounted within the housing of the mining machine with the motor shaft extending transversely to the longitudinal direction of the machine and the drive shaft journal located at the stow side thereof. The drive shaft journal is connected to reduction gearing for the drive wheel of the mining machine by a spur gear system located in the region of the stow side wall of the mining machine housing. The drive motor and the system of reduction gearing used to transmit the motor torque are installed at locations within the machine housing without impairing the arrangement of the drive gear systems required to rotate the support arms for the cutter drums and to transmit torque from the drive motor to the cutter drums. Moreover, the drive motor and the gear system for feeding movement of the mining machine are arranged in a manner to attain an especially short overall length for the housing structure of the mining machine.

It is advantageous to locate the drive motor used to produce the feed motion of the mining machine in the region of the machine housing between the support arm pivot and the associated cutter drum whereby the drive wheel and reduction gearing which consist of a planetary gear system, are located on the side of the support arm pivot facing toward the drive motor or on the side facing away from the drive motor. When the drive motor producing the feed motion is located in this position, the support arm pivot, through which the rotational motion of the cutter drum drive motor is transmitted by way of the support arm to the cutter drum, is more accessible to the drive motor for the cutter drum and the support arm pivot is readily located in the immediate vicinity of the housing wall adjacent the cutter drum drive motor.

However, in the case of a drum cutter mining machine where the machine housing retains the cutter drum support arm and provided with a drive motor for the feed motion of the machine, it is also possible to mount the drive motor for the feed motion at the side of the support arm pivot away from the cutter drum and couple the drive motor to the reduction gearing for the drive wheel by way of a spur gear system which extends over the pivot shaft. The arrangement is such that a drive shaft is mounted under or over the drive motor for the feed motion and extends in the longitudinal direction of the mining machine to thereby transmit power between the drive motor and the cutter drum. Of course, this motor arrangement requires a special construction because the spur gear system extends over the pivot shaft; however, this is not disadvantageous in view of the especially-favorable arrangement of the drive wheel which can now be located in the immediate vicinity of the end wall to the machine housing and connected to the drive motor.

When two gear systems are employed, namely a system of reduction gearing and the spur gear system for connecting the drive wheel to the drive motor, it is especially advantagenous to mount these systems in a separate support housing which can be installed in an opening provided at the stow side of the machine housing. This arrangement improves accessibility of the gear systems for transmitting the feed motion and enables, in the event of a breakdown, the changing of the support housing along with its gears at an underground site in a mine. Moreover, due to this arrangement of parts, the feed motor for the drive wheel is also fully accessible from the stow side of the mining machine. To this end, the interior of the machine housing is fitted at the stow side with horizontal pins while the support housing for the spur gear system is provided with mounting holes having a diameter corresponding to that of the pins. These mounting holes serve to center the support housing on the pins and to simplify its installation.

To improve accessibility to the drive motor arranged in a drum cutter mining machine ar a location between the support arm pivot and the associated cutter drum, the drive motor is centered in the support housing for the spur gear system and located immediately adjacent the end wall, which is made detachable, of the machine housing.

Advantageously, the detachable end wall receives the drive motor in a recess which is preferably semicircular in shape, the diameter and depth of the recess matching that of the motor. The motor is held in this recess not only axially but also radially and braced within the housing so that it is immovably fixed against the support housing for the spur gear system.

It is especially advantageous to the assembling of the support housing for the spur gearing to provide that the length of the motor centering member within the support housing is less than the width of the coupling teeth of a tooth clutch which forms the torque-transmitting connection between the spur gear system and the reduction gear system. The size of the centering member has the advantage that, in the case of need, the drive motor can be replaced without disconnecting the torque-transmitting connection between the spur gear system and the reduction gearing when withdrawing the support housing for the spur gear system.

These features and advantages of the present invention as well as others will be more fully understood when the following description is read in light of the accompanying drawings, in which.

Figure 1:
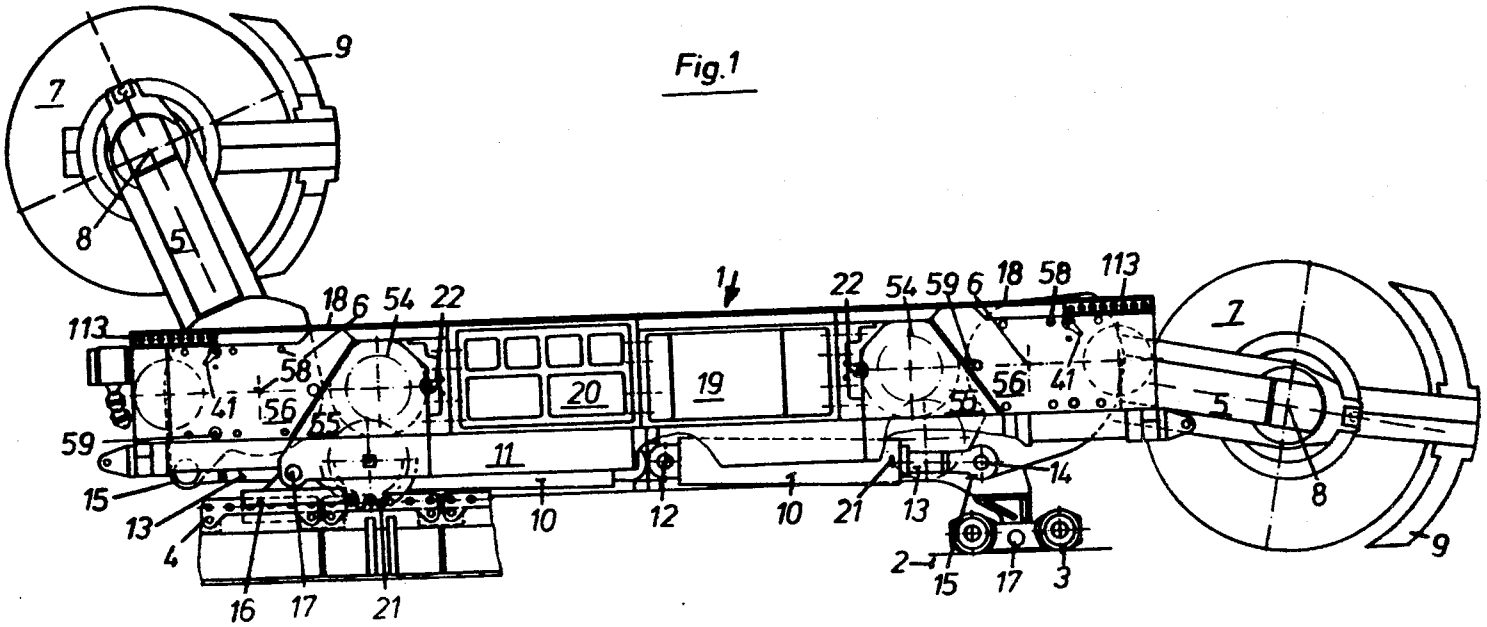
FIG. 1 is a side elevational view of a drum cutter mining machine embodying the features of the present invention.

In all the various embodiments of the present invention shown in FIGS. 1–7, a drum cutter mining machine is identified by reference numeral 1. The machine is stationed over a longwall face conveyor, not shown, which is provided on the working face side with a thrust ramp 2, only partially shown in FIG. 1. The mining machine includes roller runners 3 which rest on the thrust ramp 2. At the stow side of the face conveyor and mining machine, which is the side opposite the working side facing toward the mine face, the longwall face conveyor is provided with a toothed rack 4 made up of individual sections that extend along the course of travel by the mining machine to produce the feed motion of the mining machine. Any well known form of toothed rack is suitable but, if desired, the well known use of a chain is suitable for propelling movement of the mining machine. Cutter drum support arms 5 are pivotally mounted by pivot shafts defining horizontal pivot axes 6 that extend transversely with respect to the direction of travel by the mining machine. Each of the support arms carries a cutter drum 7 and a metal clearance plate 9 which can be swung about the rotational axis 8 of the cutter drum. The cutter drums are each pivotally positioned by actuating a piston and cylinder assembly 10 arranged close to the working face side of the drum cutter mining machine and mounted about axis 12 by a pivot shaft within a machine frame 11. The piston and cylinder assemblies 10 extend in opposite directions within the machine frame 11. Each of the piston and cylinder assemblies 10 includes a piston rod 13 connected by a pin 14 with an extension 15 of a support arm pivot shaft 27. Displacement of the piston rod brings about a pivotal movement of the support arm 5 to position the cutter drum 7 carried thereby at the requred height along the mine face.

Mounted on the machine frame 11 are individual units which constitute the machine body of the drum cutter mining machine 1. These units are rigidly bolted together and firmly attached to the machine frame 11. The frame 11 is provided with support runners of which roller runners 3 lie at the working face side of the longwall face conveyor and rest on the thrust ramp 2. At the stow side, skid runners which, like the roller runners 3, pivot about horizontal pins 17 connected thereby to machine frame 11 for resting upon the toothed rack 4 which also serves for traversing movement of the mining machine.

In the construction of parts in FIG. 1, the machine body of the drum cutter mining machine 1 consists of four units, namely the two machine housings 18 located at the opposite ends of the machine body, the drive motor 19 located between the machine housings and an additional constructional unit 20 is which there is installed the electrical control elements for the drum cutter mining machine as well as a hydraulic system coupled to actuate the piston and cylinder assembly 10 as required for movement of the cutter drum support arms 5. The hydraulic system incorporates a control element and a pressure generator, e.g., a pump. Both of the machine housings 18 include gear systems to transmit torque from the single drive motor 19 to the cutter drums 7 and also gear systems to transmit torque to rotate two drive wheels 21 that engage the rack gear teeth of the toothed rack 4. In the form of the present invention shown in FIG. 2, the gear systems are shown schematically. The drive motor 19 is connected through a unit 20 by a gear system which includes a drive shaft 24 coupled to a pair of meshing bevel gears 25. The connection between the drive motor 19 and the bevel gears 25 includes a toothed clutch 23 which can be operated from a location outside the machine by means of a lever 22. The motor 19 is engaged and disengaged from the gear system by movement of the lever 22. The bevel gears 25 are housed within a hollow opening 26 in the support arm pivot shaft 27. The support arm pivot shaft 27 has a radial opening 28 through which shaft 24 extends from unit 20 into the hollow opening 26 in the support arm pivot shaft 27. Torque from the drive motor 19 is transmitted by shaft 29 to the cutter drum support arm 5 and thence therealong by spur gears including spur gears 30–33 to a reduction gearing, not shown, housed within the cutter drum 7. From this reduction gearing, the torque is transmitted to the main body of the cutter drum 7 which encloses the reduction gearing.

Spaced-apart bearings 34 and 35 carry the support arm pivot shaft 27 for pivotal movement in response to the force developed by the piston and cylinder assembly 10. The pivotal movement of the support arm is at most 70°. The radial opening 28 in the periphery of the support arm pivot shaft 27 is constructed to accommodate the 70° maximum pivotal movement of the support arm.

Figure 2:
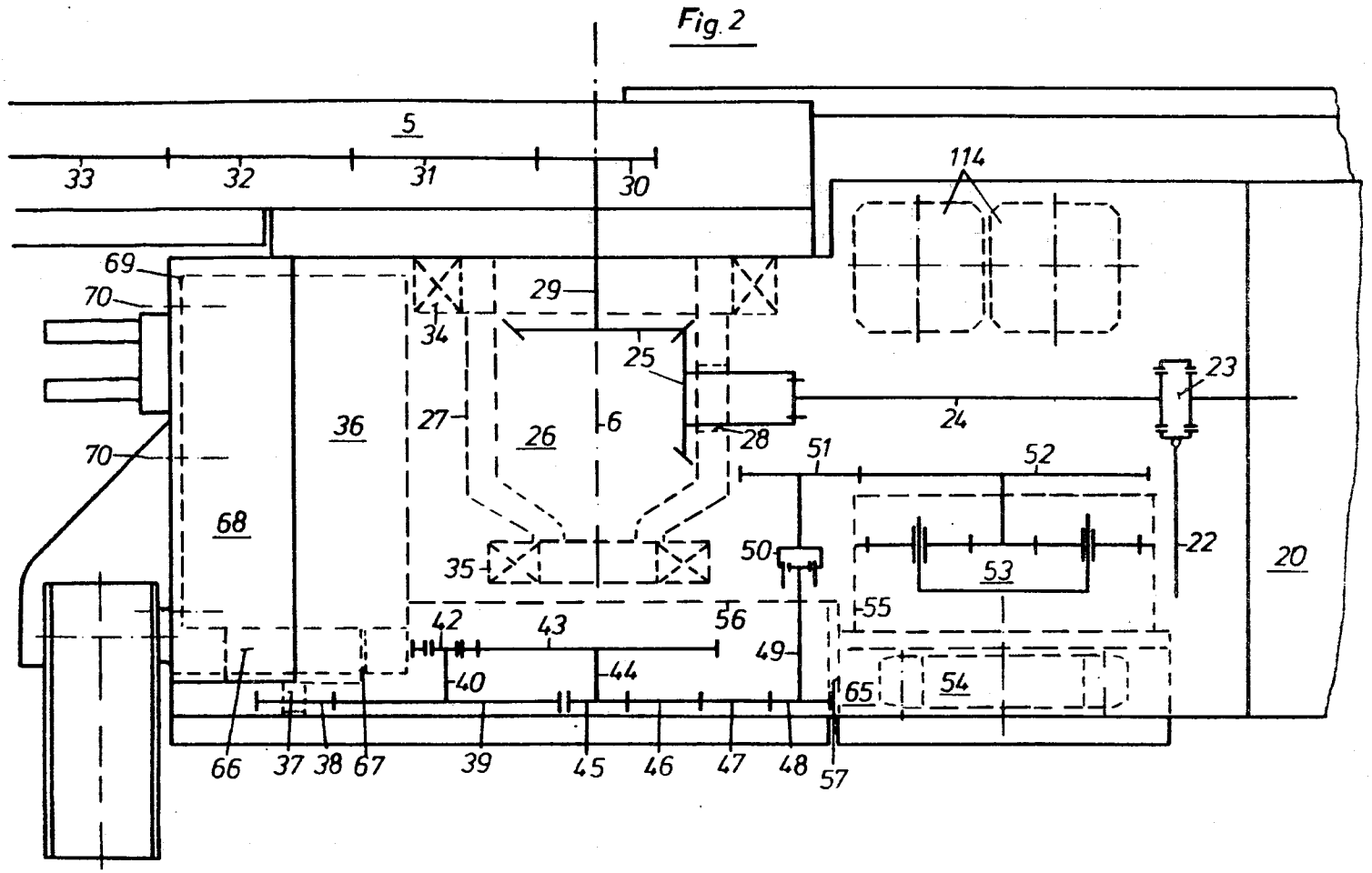
FIG. 2 is a partial plan view showing schematically one embodiment of a drive system and arrangement of parts in a drum cutter mining machine of the present invention.

In the embodiment of the invention shown in FIGS. 1 and 2, each of the two machine housings 18 is equipped with a drive motor 36 for delivering torque to a drive wheel 21 while in meshing engagement with the toothed rack 4. As shown in FIG. 2, the drive motor 36 is mounted with the rotational axis of the torque output shaft 37 extending transversely to the travel direction of the drum cutter mining machine. The torgue output shaft 37 faces toward the stow side of the mining machine within the machine housing 18. Mounted on shaft 37 is a spur gear 38 meshing with spur gear 39 on shaft 40 which has a toothed clutch 42 that can be engaged and disengaged by means of a hand-operated lever 41 (FIG. 1). The torque at the drive output side of the clutch is transmitted by a spur gear 43 on shaft 44 which carries a spur gear 45 in meshing engagement with a train of spur gears 46–48. Spur gear 48 is mounted on a shaft 49 which transmits torque through clutch 50 to spur gear 51 in meshing engagement with spur gear 52. The torque output from spur 52 is imparted to a reduction gearing 53 wherein rotational motion is reduced and transmitted through a toothed gear 54 which meshes with drive wheel 21. The reduction gearing 53 takes the form of a planetary gear system located in a separate gear housing 55 which is mounted concentrically with respect to the rotational axis of the toothed gear 54.

In addition to the reduction gearing 53, the train of spur gears 38–48 is also mounted in a separate gear housing 56. Both gear housings 55 and 56 are inserted from the stow side into a suitable opening 57 (FIG. 5) in the machine housing 18 where the gear housings 55 and 56 are secured in place. For this purpose, for example, the construction is such that gear housing 56 is not only fitted with separate fastening screws 58 but also provided with centering holes 49 whereby centering can be effected by sliding movement onto pins 60 of corresponding diameter in the machine housing 18.

Figure 6:
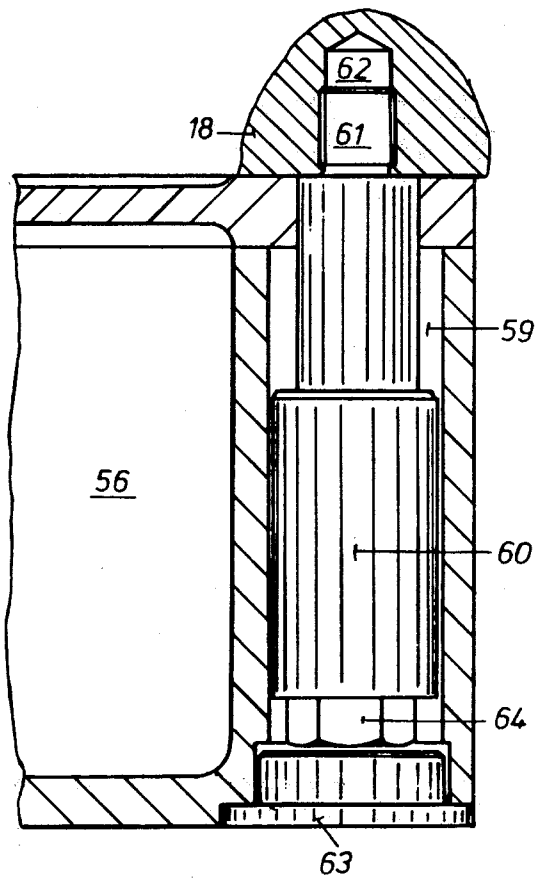
FIG. 6 is a sectional view taken along line A–B of FIG. 5.
Figure 7:
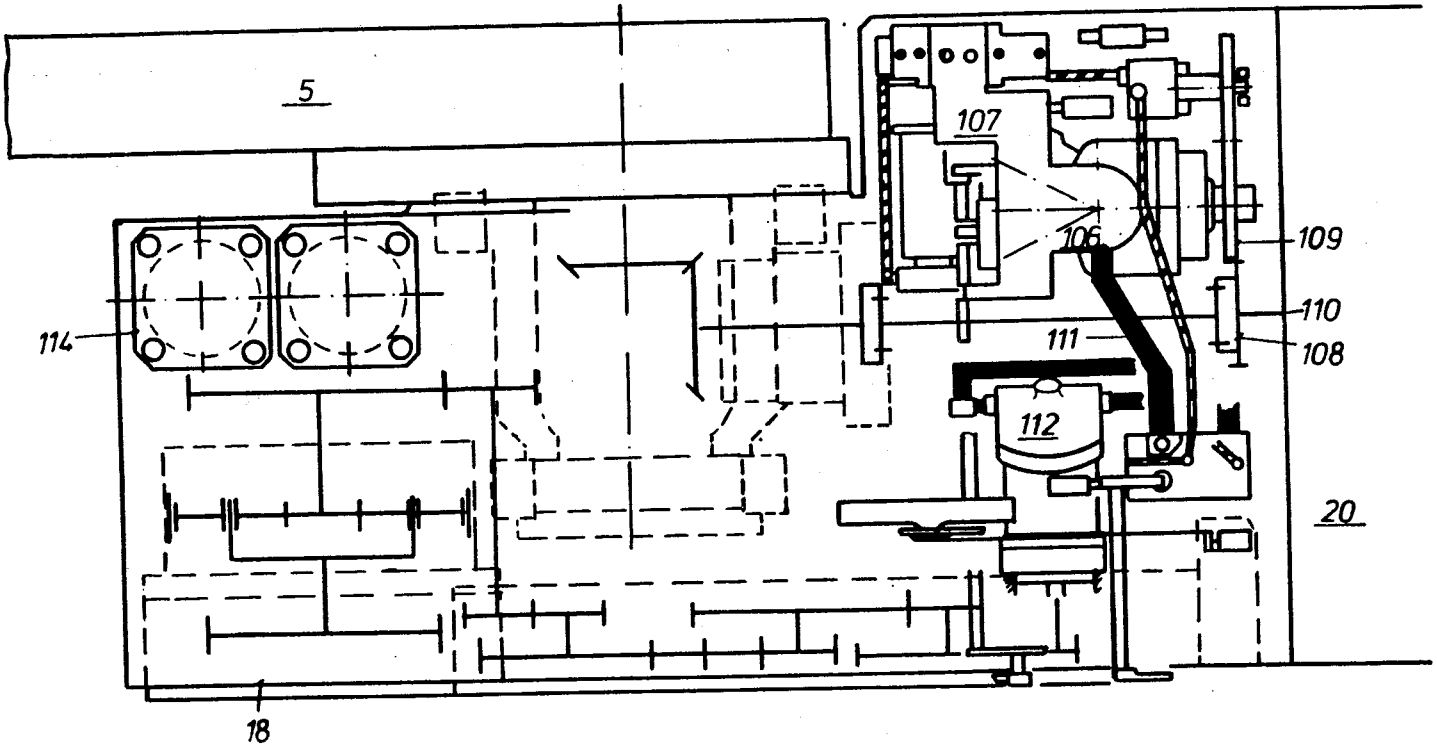
FIG. 7 is a view similar to FIG. 2 but illustrating a fourth embodiment of the present invention.

As shown in FIG. 6, pin 60 is located in the centering hole 59 of gear housing 56 and closed off by a cover plate 63. The pin 60 has a projected threaded journal 61 extending into a threaded bore 62 in the machine housing 18. A hexagonal head 64 on the free end of the pin is used to threadedly secure the pin 60 in place. The pin includes two shaft sections of different diameters serving to center the gear housing 56 and to guide it in the longitudinal direction of the pin after the fastening screws 58 are loosened. Gear housing 55, which contains the reduction gearing 53, is secured in a similar manner within an opening 57 at the stow side of the machine housing 18. The gear housing 55 includes antechamber 65 that is open at the bottom and accommodates toothed gear 54 which engages the drive wheel 21. The drive wheel 21 engages the teeth of the gear rack while mounted inside the machine frame 11 immediately adjacent the skid runner 16.

Drive motor 36 has a cylindrical extension 66 received in a mating engagement in a recess of the gear housing 56 in the region of the torque output shaft 37 of the drive motor. The drive motor 36 is centered in the recess at a location directly adjacent end wall 68 of the machine housing 18. The motor mates about half of its periphery in a recess 69 which corresponds to the diameter and length of the motor. The recess 69 being located in end wall 68 is releasably attached to the machine housing 18 and held in place by threaded fasteners 70. The releasable end wall 68 supports the drive motor 36 within the machine housing 18 and, since the end wall can be removed, it simplifies operation for the assembly and disassembly of the parts. For this reason, the width of the recess 67 is chosen so that it is smaller than the width of the teeth in the cluth coupling 50 to enable, in the case of need, the removal and exchange of motor 36 without the need to break the connection between the system of spur gearings 38–48 and the reduction gearing 53. The slide path in the housing 56 which is determined by the smaller diameter section of pin 60, is sufficient to allow the extension 66 to move out of the recess 67 so that when the end wall 68 is removed, drive motor 36 can be removed from the machine housing 18.

In the embodiment of the invention illustrated in FIGS. 1 and 2, the spur gear systems 38–48 extend to opposite sides of the pivot shaft 27 to which there is attached the support arm 5 of the cutter drum 7. Thus, the spur gear system forms the torque-transmitting connection between drive motor 36 at one side of the pivot shaft and the reduction gearing 53 located at the other side. In this embodiment, the axis 6 of support arm pivot shaft 27 lies behind skid runner 16. This arrangement of parts is especially advantageous when cutting the drift profile because the drum cutter mining machine can travel relatively close to the end of the longwall face without hindrance by the drive for the face conveyor or reversing station.

Figure 3:
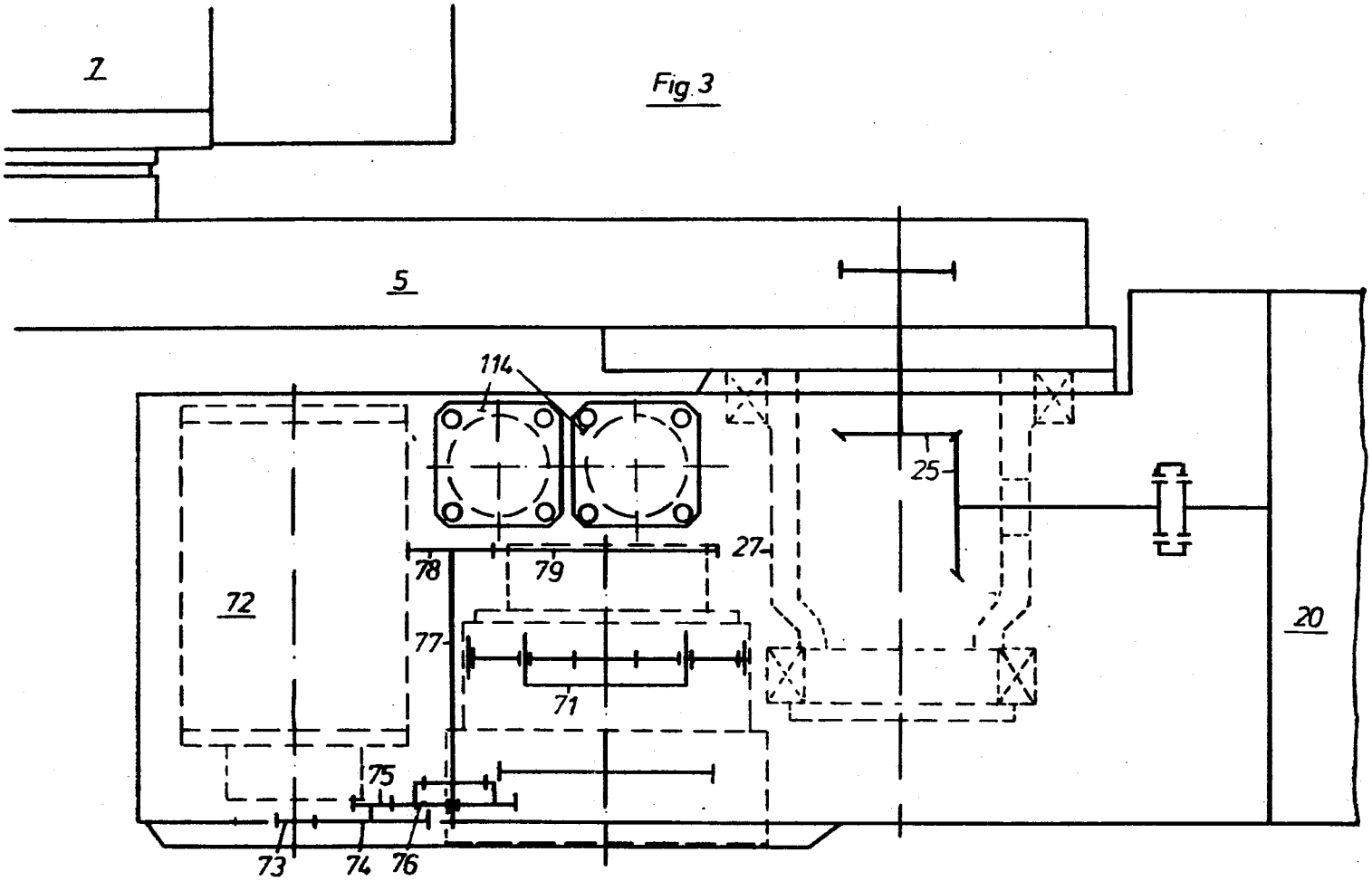
FIG. 3 is a view similar to FIG. 2 but illustrating a second embodiment.

In the embodiment of the invention illustrated in FIG. 3, the reduction gearing 71 is located between a drive motor 72 in the machine housing 18 and the support arm pivot shaft 27. A gear drive system includes the spur gears 73–76. The shaft 77 with spur gear 78 thereon meshes with spur gear 79 and forms the torque-transmitting connection between the drive motor 72 and reduction gearing 71. As a result, the stow side skid runners, not shown, are located in the region between the axis of the torque output shaft of motor 72 and the rotational axis of reduction gearing 71. Thus, the skid runners are located practically at the ends of the machine body. Moreover, with this construction of parts, the support arm pivot shaft 27 is located relatively close to unit 20 or to the drive motor 19 so that the connection between the drive motor 19 and a pair of bevel gears 25 housed within the support arm pivot shaft is relatively short.

Figure 4:
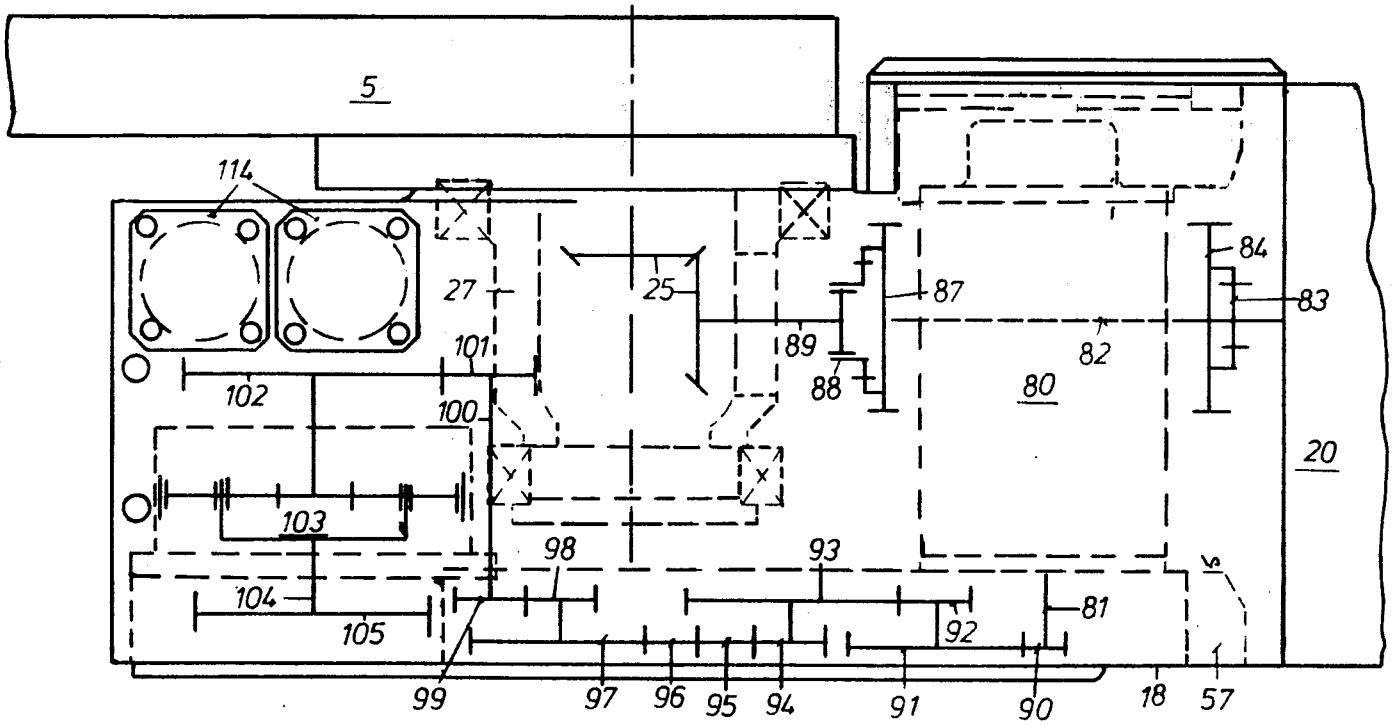
FIG. 4 is a view similar to FIG. 2 but illustrating a third embodiment.
Figure 5:
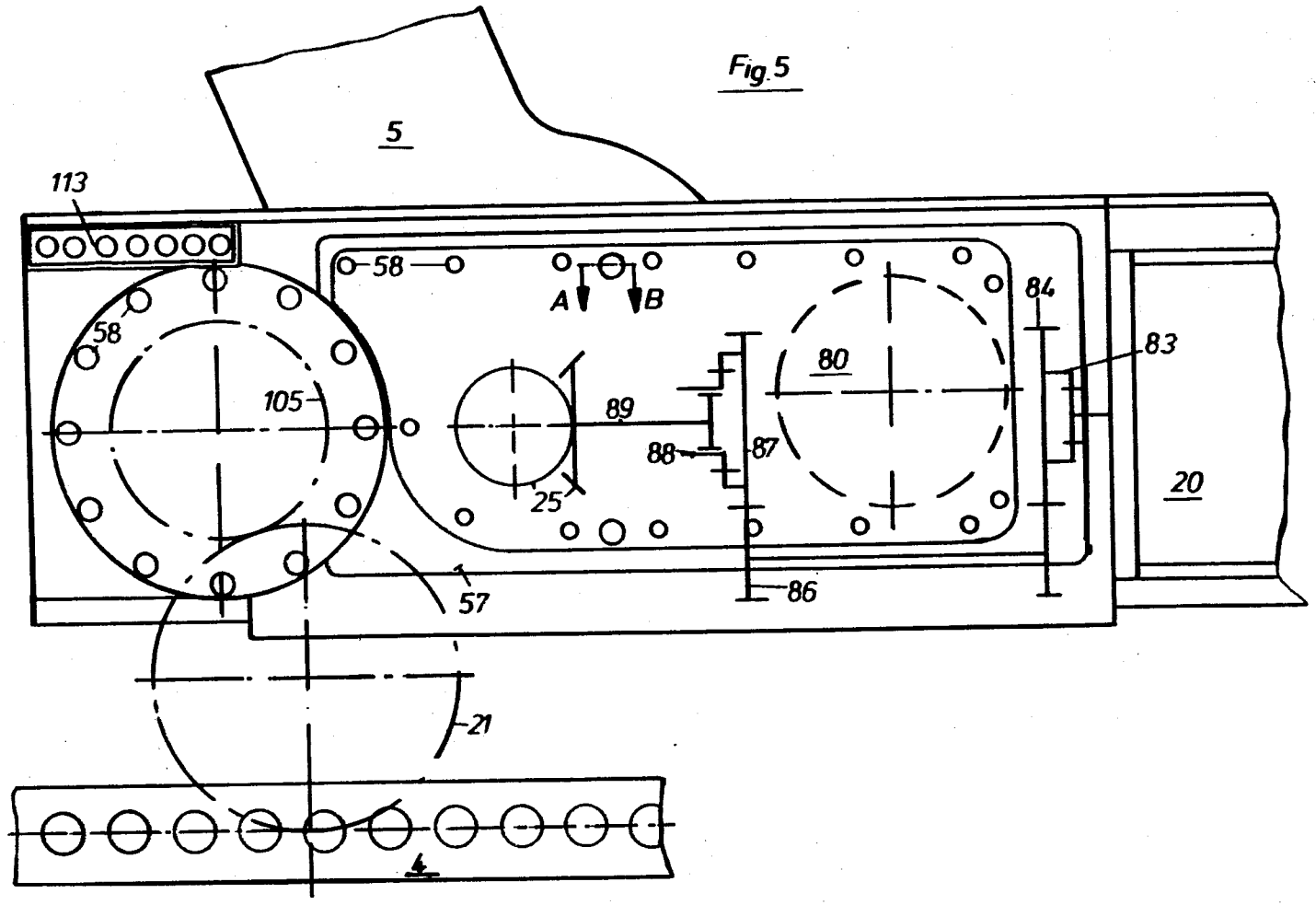
FIG. 5 is a partial side view of the drum cutter mining machine shown in FIG. 4.

In the embodiment of the invention shown in FIGS. 4 and 5, a drive motor 80 provides the desired torque for producing the feed motion of the drum cutter mining machine. This drive motor is located in the housing 18 at the end wall which is opposite the location of the drive motor according to the embodiment of FIG. 3. The drive motor 80 is mounted immediately adjacent the drum cutter drive motor 19 or unit 20. Also, in this embodiment, the drive motor 80 is mounted transversely to the longitudinal direction of the mining machine with the torque output shaft 81 extending toward the stow side of the mining machine. A shaft 82 is located beneath the drive motor 80 and one end of shaft 82 is connected by a toothed clutch 83 and spur gears 84 and 85 to the cutter drum motor 19 through unit 20. The other end of the shaft 82 is coupled by spur gears 86 and 87 through a toothed clutch 88 and shaft 89 to the pair of bevel gears 25 within the support arm pivot shaft 27. The torque-transmitting drive train between drive motor 80 and drive wheel 21 is formed by a spur gear 90 on the drive output shaft 81 of the drive motor. Spur gear 90 meshes with spur gears 91–99. Spur gear 99 has a shaft 10 on which there is provided a spur gear 101 meshing with spur gear 102, the latter transmitting torque to a reduction gearing 103 having an output shaft 104 carrying a toothed wheel 105 which engages the drive wheel 21 therebelow. As described previously, the drive wheel 21 engages the toothed rack 4.

In the foregoing description of the embodiments of the present invention, the machine housing 18 is also provided with its own particular drive motor having a rotational speed that can be steplessly controlled. This drive motor is employed only for actuating the drive wheel 21 to produce the feed motion of the drum cutter mining machine 1. On the other hand, in the embodiment of the invention shown in FIG. 7, the motor 19 drives the cutter drums 7 and is also employed to provide the necessary torque to drive wheels 21 in order to produce the feed motion of the mining machine. In this embodiment, located in the machine housing 18 is a hydraulic pump 106 with a control block 107. The pump is connected to the drum cutter drive motor 19 by spur gears 108 and 109 which form with other spur gears at a lower level, not shown, the torque-transmitting connection to a shaft 110 which passes through unit 20. The hydraulic pump 106 delivers pressurized hydraulic fluid in a pipeline 111 to a hydromotor 112 for generating the necessary torque output. A spur gear system similar to that shown in the embodiment of FIG. 4 transmits torque from the hydromotor 112 to the reduction gearing connected with drive wheel 21.

In all of the embodiments of the present invention, a drum cutter mining machine is provided at both ends at the stow side with control elements 113. Also, coolers 114 are located in the machine housing 18. Lubricating oil for the support arm gear and the reduction gearing 53, 71 and 103 is connected in series with the drive wheel and returned to the cooler. It is to be understood that the reduction gearing 53, 71 and 103 are preferably a planetary form of gear reducing system.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A drum cutter mining machine adapted for movement along a mine face including the combination of:

a machine frame including a machine body and machine housings joined to the opposite ends of the machine body, a cutter drum including a support arm carried by each of said machine housings, drive motor means supported by said machine frame, means extending along the course of travel by the mining machine for propelling movement thereof along the mine face, a drive wheel carried by at least one of said machine housings to engage said means extending along the course of travel, a drive gear means carried by each of said machine housings to transmit torque from said drive motor means to the cutter drum supported thereby, and a drive train carried by the same machine housing which carries said drive wheel to transmit torque thereto from said drive motor means for propelling movement of said machine frame along the mine face.

2. The drum cutter mining machine according to claim 1 wherein said drive motor means includes a feed drive motor mounted within the machine housing carrying said drive wheel, said feed drive motor having the torque output shaft at the stow side arranged such that the rotational axis thereof extends transversely to the course of travel by the mining machine, and wherein said drive train includes a spur gear system coupled with reduction gearing between said feed drive motor and said drive wheel.

3. The drum cutter mining machine according to claim 2 wherein said drive motor means further includes a cutter drive motor for rotating the cutter drums carried by said machine housing.

4. The drum cutter mining machine according to claim 2 further including a pivot shaft coupled to said support arm of a cutter drum for support by one of said machine housings, said feed drum motor being supported in one of said machine housings between said pivot shaft and a cutter drum while supported by the pivot shaft, said reduction gearing including a planetary gear system arranged with said drive wheel at one side of said pivot shaft for support by one of said machine housings.

5. The drum cutter mining machine according to claim 4 wherein said planetary gear system and said drive wheel are supported in the machine housing between said pivot shaft and said feed drive motor.

6. The drum cutter mining machine according to claim 4 wherein said planetary gear system and said drive wheel are supported in the machine housing at the side of said pivot shaft facing away from said feed drive motor.

7. The drum cutter mining machine according to claim 1 wherein said drive motor means includes a feed drive motor supported by one of said machine housings for providing torque to only move said machine along the course of travel, said drum cutter mining machine further including a pivot shaft coupled to said support arm of a cutter drum for support by one of said machine housings, said feed drive motor being arranged at the side of said pivot shaft facing away from the cutter drum coupled thereto through a support arm, said drive train including a spur gear system coupled through a reduction gear system to said drive wheel, said drive gear means including a shaft member extending in a vertically-spaced transverse relation across said feed drive motor, said drive motor means further including a cutter drum drive motor coupled by said drive gear means including said shaft member to rotate the cutter drum supported by the pivot shaft on the machine housing.

8. The drum cutter mining machine according to claim 1 wherein said machine frame further includes at least one detachable gear housing, at least one of said machine housings including an opening at the stow side thereof for supporting said gear housing, said drive train including a reduction gear system and spur gear system located within said detachable gear housing.

9. The drum cutter mining machine according to claim 8 further including horizontal support fasteners carried by the said at least one of said machine housings having an opening at the stow side, said detachable gear housing having a mounting opening to receive said horizontal support fasteners.

10. The drum cutter mining machine according to claim 2 or 3 wherein said machine housing mounting said feed drive motor includes a detachable end wall, and wherein said drive train includes a support housing with a spur gear system for central mounting of said feed drive motor to said support housing adjacent said detachable end wall.

11. The drum cutter mining machine according to claim 2 or 3 wherein said machine housing mounting said feed drive motor includes a detachable end wall having a recess dimensioned to receive said feed drive motor.

12. The drum cutter mining machine according to claim 2 or 3 wherein said housing mounting said feed drive motor includes a detachable end wall and wherein said drive train includes a support housing with a spur gear system for central mounting of said feed drive motor to said support housing adjacent said detachable end wall, said support housing includes a feed drive motor centering member, said drive train further including a reduction gear system with said spur gear system, the length of said centering member being less than the width of said coupling teeth.

* * * * *